US007330687B2

(12) United States Patent
Kim

(10) Patent No.: US 7,330,687 B2
(45) Date of Patent: Feb. 12, 2008

(54) IMAGE FIXING UNIT HAVING PREHEATING MEANS FOR IMAGE FORMING APPARATUS AND IMAGE FIXING METHOD USING THE SAME

(75) Inventor: Yu-Man Kim, Seongnam-si (KR)

(73) Assignee: Samsung Electronics, Co., Ltd., Suwon-Si, Gyeonggi-do (KR)

( * ) Notice: Subject to any disclaimer, the term of this patent is extended or adjusted under 35 U.S.C. 154(b) by 173 days.

(21) Appl. No.: 10/882,403

(22) Filed: Jul. 2, 2004

(65) Prior Publication Data

US 2005/0129430 A1 Jun. 16, 2005

(30) Foreign Application Priority Data

Dec. 16, 2003 (KR) ..... 10-2003-0092099

(51) Int. Cl.
*G03G 15/20* (2006.01)

(52) U.S. Cl. ..... 399/328

(58) Field of Classification Search ..... 399/328, 399/329, 330, 335

See application file for complete search history.

(56) References Cited

U.S. PATENT DOCUMENTS 4,731,635 A 3/1988 Szlucha et al.
5,465,146 A 11/1995 Higashi et al.
5,729,812 A * 3/1998 Moser ..... 399/329
5,978,631 A 11/1999 Lee
6,037,576 A * 3/2000 Okabayashi et al. ..... 399/330
6,272,309 B1 * 8/2001 Kitazawa et al. ..... 399/329
RE37,859 E * 9/2002 Lior et al. ..... 399/57
6,577,840 B2 * 6/2003 Hachisuka et al. ..... 399/329

FOREIGN PATENT DOCUMENTS

JP 2000-019877 1/2000
JP 2002-311725 10/2002
KR 2003-015541 2/2003

* cited by examiner

*Primary Examiner*—David M. Gray
*Assistant Examiner*—Ruth N. LaBombard
(74) *Attorney, Agent, or Firm*—Roylance, Abrams, Berdo & Goodman, L.L.P.

(57) ABSTRACT

An image fixing unit for a wet image forming apparatus comprises a fixing section and a preheating means. The fixing section has a first fixing roller, and a second fixing roller which rotates in close contact with the first fixing roller to feed paper through a gap (a fixing nip) between the first and second fixing rollers. The preheating means is disposed on a feed path of the paper before the paper enters the fixing nip, and comes into contact with a non-image surface of the paper to allow the image to be exposed to the air. Either one of the first and second fixing rollers is disposed to bring a surface thereof into contact with the non-image surface of the paper before the paper passes through the fixing nip, and the fixing roller brought into contact with the paper has a heating element mounted therein.

14 Claims, 4 Drawing Sheets

IMAGE FIXING UNIT HAVING PREHEATING MEANS FOR IMAGE FORMING APPARATUS AND IMAGE FIXING METHOD USING THE SAME

CROSS-REFERENCE TO RELATED APPLICATION

This application claims benefit under 35 U.S.C. §119(a) of Korean Patent Application No. 2003-92099, filed on Dec. 16, 2003, the entire contents of which are hereby incorporated by reference.

BACKGROUND OF THE INVENTION

1. Field of the Invention

The present invention relates to a wet image forming apparatus and, more particularly, to an image fixing unit for a wet image forming apparatus, designed to improve the quality of a final image fixed on paper by smoothly evaporating vapor of a liquid carrier generated in the process of fixing.

2. Description of the Related Art

Wet image forming devices are generally constructed to develop desired images with a developer solution, such as a mixture of a liquid carrier and a toner comprised of electrically charged particle, and then to transfer the developed images to paper.

FIG. 1 illustrates a fixing section of a conventional image forming apparatus. As shown, an image C1 transferred on paper C through a transfer process is fixed on the paper C when the paper C passes through a fixing nip or gap between first and second fixing rollers 1 and 3.

Because the first and second fixing rollers 1 and 3 have heating element mounted therein and are pressed relative to each other at proper temperature and pressure, a liquid carrier contained in a toner passing through the fixing nip under the proper temperature and pressure is evaporated. Simultaneously, an adhesive force between the paper and the toner is generated.

Before passing through the fixing nip the toner contains a liquid carrier. The amount of liquid carrier in the toner ranges from at or about 10% to at or about 80%. While the toner passes through the fixing nip under the proper temperature and pressure, the liquid carrier is evaporated at the fixing nip, but typically the vapor fails to escape smoothly. This causes marks, such as a ripple pattern, to be left on the image fixed on the final paper C, thus resulting in poor image quality.

In order to solve this problem, one prior art solution has been disclosed in U.S. Pat. No. 5,465,146, the entire contents of which are disclosed herein by reference.

As shown in FIG. 2, the configuration disclosed in U.S. Pat. No. 5,465,146 is composed of a drying section 11 for drying the paper C onto which the images C1 are transferred in a non-contact manner, and a fixing section 13 for heating and pressing the paper C to fix the images C1. The drying section 11 includes a first roller R1 in which a first heater H1 is mounted, and a drying belt B traveling between the first roller R1 and a second roller R2. The fixing section 13 includes the second roller R2, and a third roller R3 having a second heater H2 mounted therein and rotating in close contact with the second roller R2 with the drying belt B in between second roller R2 and third roller R3.

This structure, however, has a drawback in that the drying process has a low thermal efficiency because the drying section 11 is designed in a non-contact heating manner.

Specifically, the paper C is heated in the non-contact manner through a radiant heat of the drying belt B heated by the first heater H1, so that although the surface temperature of the drying belt B is high, the paper C supplied with the heat of the drying belt B has a temperature falling far short of the surface temperature of the drying belt B.

To solve such a drawback, another prior art solution has been disclosed in Korean Patent Publication No. 2003-015541 (published on Feb. 25, 2003), the entire contents of which are incorporated herein by reference.

As shown in FIG. 3, the configuration disclosed in Korean Patent Publication No. 2003-15541 is composed of a charging section 10 which is installed on a feed path of paper to apply an electric potential that brings toner into close contact with the paper, a drying section 20 which heats the paper C in direct contact with the drying section 20 to dry the images, and a fixing section 30 which heats and presses the paper to fix the images.

The drying section 20 includes a drying belt 21 that moves along an endless path between a drying roller 22 and a supporting roller 23, a backup roller 24 that rotates in close contact with the drying belt 21, a heater 22*a* mounted in the drying roller 22, and a regeneration roller 25 having another heater 25*a* mounted therein for evaporating the solvent absorbed into the drying belt 21 by contact with the drying belt 21.

Because the surface of the paper onto which the images are formed (hereinafter called a "image surface") is configured to directly contact the drying belt 21, however, the evaporated liquid carrier remains between the drying belt 21 and the paper C and cannot escape. This is a problem in that this also generates the aforementioned image defect of a ripple pattern on the final images of the paper which has passed through the fixing section 30.

SUMMARY OF THE INVENTION

It is, therefore, an objective of the present invention to provide an image fixing unit for a wet image forming apparatus, in which, during drying of the paper, an image surface of the paper is exposed to the air, and thus a liquid carrier is smoothly evaporated, thereby enhancing the quality of the image.

In order to accomplish this objective, according to a first aspect of the present invention, there is provided an image fixing unit for a wet image forming apparatus, comprising a fixing section and a belt. The fixing section has a first fixing roller, and a second fixing roller which rotates in close contact with the first fixing roller to feed paper through a gap (a fixing nip) between the first and second fixing rollers which are contacted closely. The belt is disposed on a feed path of the paper, and is supported by a preheating roller spaced a predetermined distance apart from the first fixing roller to move along an endless path, so that the belt is adapted to be fed in contact with a non-image surface of the paper (a surface of the paper on which no image is formed). In accordance with the first aspect of the present invention, at least one of the first and second fixing rollers has a heating element mounted therein. Further in accordance with the first aspect of the present invention, the amount of liquid carrier is reduced to a range from at or about 3% to at or about 20% by weight before the image enters the fixing nip.

According to a second aspect of the present invention, there is provided an image fixing unit for a wet image forming apparatus, comprising a fixing section having a first fixing roller and a second fixing roller which rotates in close contact with the first fixing roller to feed paper through a gap (a fixing nip) between the first and second fixing rollers contacted closely, wherein either one of the first and second fixing rollers is disposed to bring a surface thereof into contact with a non-image surface of the paper (a surface of the paper on which no image is formed) before the paper passes through the fixing nip, and the fixing roller brought into contact with the paper has a heating element mounted therein.

Furthermore, according to the second aspect of the present invention, the first and second fixing rollers have different diameters respectively, and the non-image surface of the paper comes into contact with the surface of the fixing roller having a large diameter. The fixing roller whose surface does not come into contact with the non-image surface of the paper further comprises a heating element. Further in accordance with the second aspect of the present invention, the image contains a liquid carrier in a range from at or about 3% to at or about 20% by weight when the image enters the fixing nip.

According to a third aspect of the present invention, there is provided an image fixing unit for a wet image forming apparatus, comprising a fixing section and a preheating means. The fixing section has a first fixing roller, and a second fixing roller which rotates in close contact with the first fixing roller to feed paper through a gap (a fixing nip) between the first and second rollers which are contacted closely. The preheating means is disposed on a feed path of the paper before the paper enters the fixing nip, and comes into contact with a non-image surface of the paper to allow the image to be exposed in the air.

According to a fourth aspect of the present invention, there is provided a method for fixing an image in a wet image forming apparatus, comprising preheating a non-image surface of a paper containing an image that has a content of liquid carrier to evaporate a substantial portion of the liquid carrier in the paper, and fixing the preheated paper to adhesively secure the image to the paper. The step of preheating comprises contacting the non-image surface of the paper with a pre-heating element while an image surface of the paper is exposed to air. The pre-heating element comprises a first fixing roller, a pre-heating roller and belt configured in an endless loop around a first fixing roller and a pre-heating roller. At least either the first fixing roller or the pre-heating roller contains a heating element.

Furthermore, according to the fourth aspect of the present invention, the image has a content of the liquid carrier in a range from at or about 3% to at or about 20% by weight when the image enters the fixing nip.

Furthermore, according to the fourth aspect of the present invention, the fixing step comprises passing paper between the first and second fixing roller. At least one of the first and second fixing rollers comprises a heating element.

Furthermore, according to the fourth aspect of the present invention, the step of pre-heating comprises heating a pre-heating roller by an internally contained heating element, wherein the preheating roller is in rotational communication with a first fixing roller by a belt, such that the preheating roller heats the non-image surface of the paper containing the content of liquid carrier, and evaporating a substantial portion of the liquid carrier in the paper.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF THE PREFERRED EMBODIMENTS

The present invention will now be described more fully hereinafter with reference to the accompanying drawings, in which exemplary embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. Like numbers refer to like elements throughout the specification.

EXAMPLE 1

Figure 1:
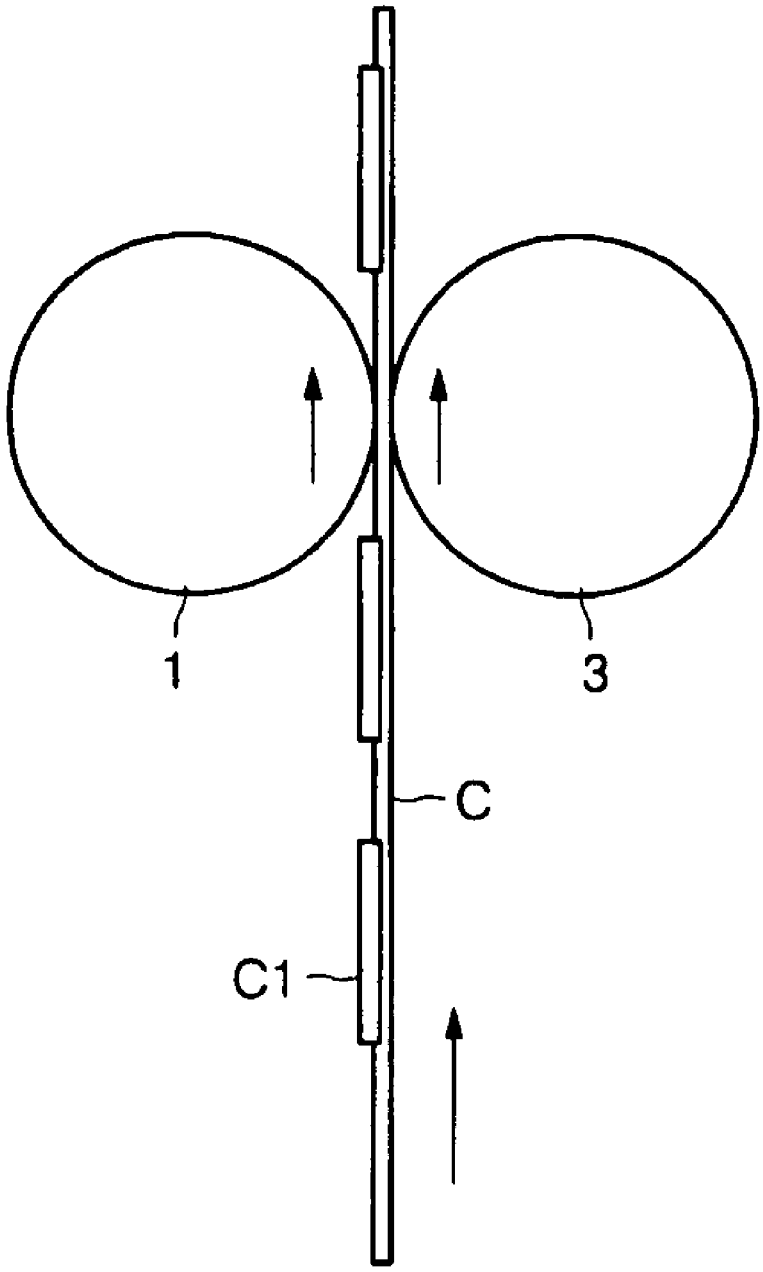
FIG. 1 (PRIOR ART)
FIG. 1 illustrates a first example of an image fixing unit of a conventional wet image forming apparatus.
Figure 2:
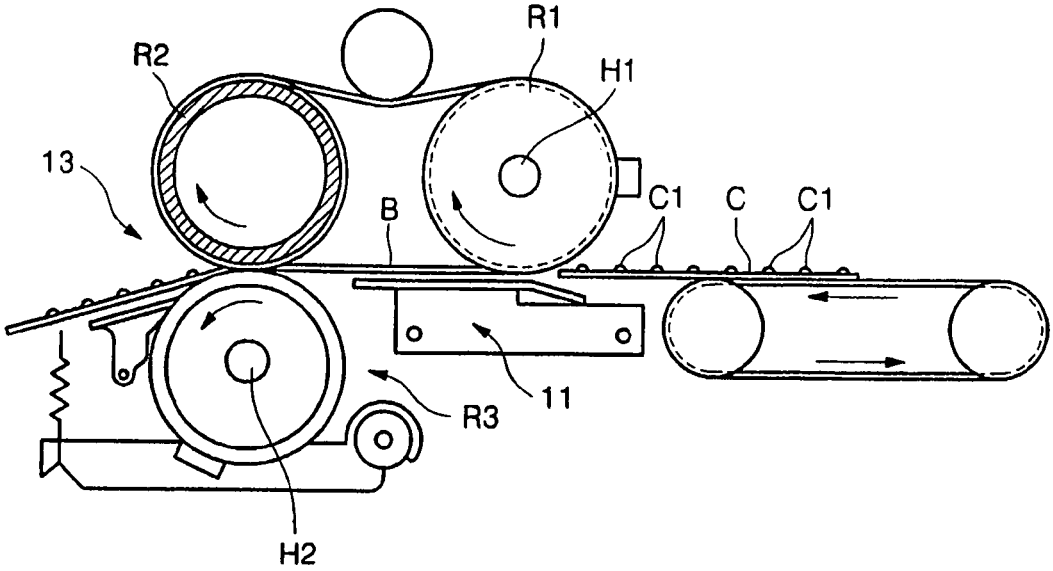
FIG. 2 (PRIOR ART)
FIG. 2 illustrates a second example of an image fixing unit of a conventional wet image forming apparatus.
Figure 3:
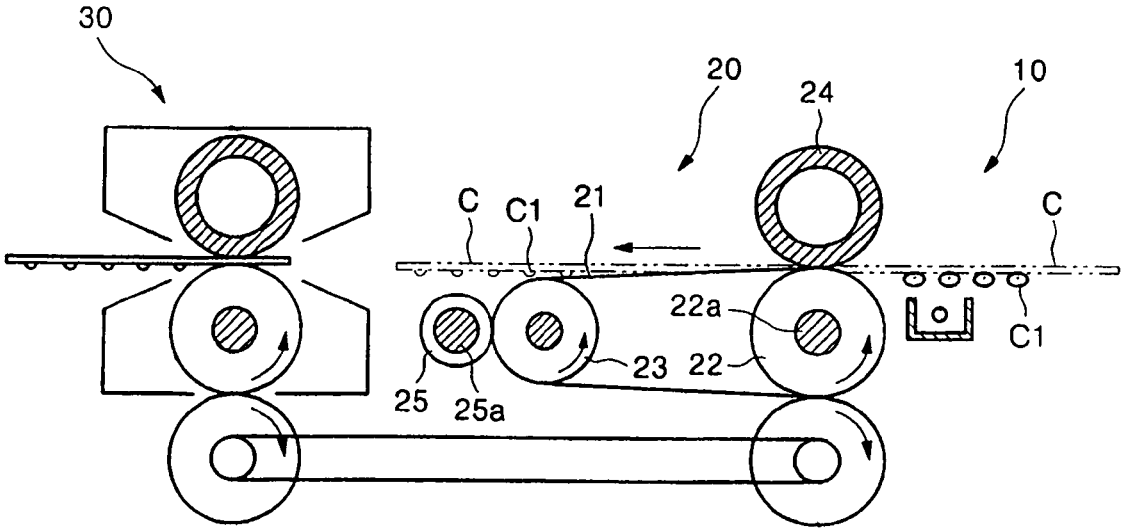
FIG. 3 (PRIOR ART)
FIG. 3 illustrates a third example of an image fixing unit of a conventional wet image forming apparatus.
Figure 4:
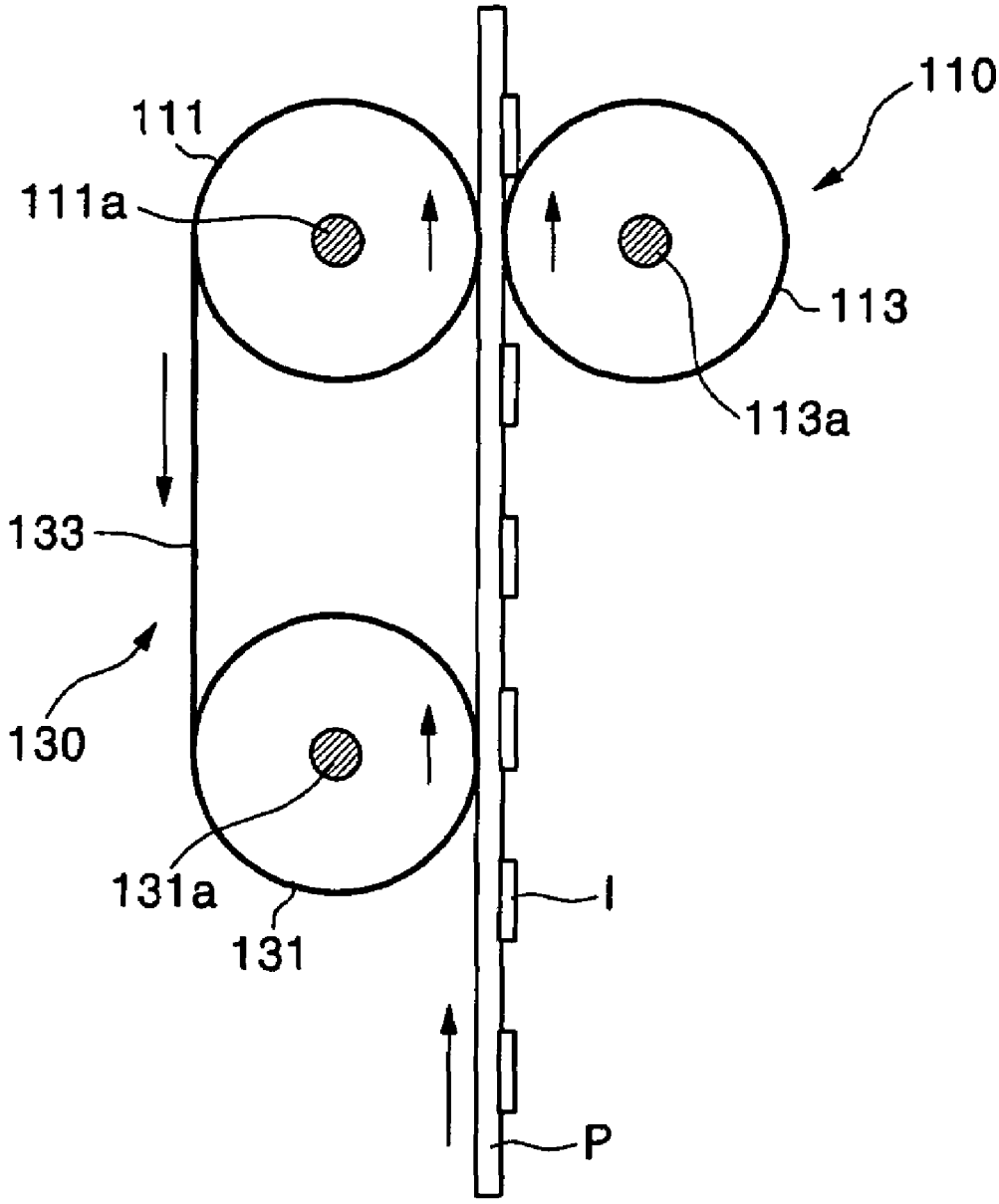
FIG. 4 illustrates an image fixing unit of a wet image forming apparatus according to an embodiment of the present invention.

As shown in FIG. 4, an image fixing unit is comprised of a fixing section 110 and a preheating means 130.

The fixing section 110 includes a first fixing roller 111 and a second fixing roller 113, wherein the second fixing roller 113 rotates in close contact with the first fixing roller 111 to feed paper P through a gap (a fixing nip) between the rollers which are contacted closely.

The preheating means 130 consists of a belt 133, which is disposed on a feed path of the paper P so as to come into contact with a non-image surface of the paper (a surface of the paper on which no image is formed) and is supported by a preheating roller 131 spaced a predetermined distance apart from the first fixing roller 111 to move along an endless path formed between the preheating roller 131 and the first fixing roller 111. Here, the preheating roller 131 has a third heating element 131*a* mounted therein.

Similarly, a first heating element 111*a* is mounted in the first fixing roller 111, and a second heating element 113*a* is also mounted in the second fixing roller 113.

The paper P onto which at least one image I is formed is conveyed by the belt 133, thereby entering the fixing nip where the first and second fixing rollers 111 and 113 are closely contacted. The paper P has one surface onto which no image is formed (hereinafter referred to as the "non-image surface") and the other surface onto which the image is formed (hereinafter referred to as the "image surface"). Of course, it should be understood that by "non-image surface", there exists no image which needs to be fixed by the fixing unit. It should be further understood, however, that a pre-existing image may be present on the "non-image surface", as in an image previously printed and fixed on the reverse side of the paper P during full-duplex printing, for example. The non-image surface comes into contact with the belt 133, and the image surface is exposed to the air. Hence, when a liquid carrier contained in the image I is evaporated by heat generated from the preheating roller 131, the liquid carrier is smoothly released in the air. The image I contains the liquid carrier in a range from at or about 70% to at or about 80% just before reaching the preheating roller 131, and is then released into the air while being heated by the preheating roller 131. After heating, the liquid carrier is reduced in the image I to a range from at or about 3% to at or about 20% just before entering the fixing nip. As a result, the vapor of the liquid carrier which is generated at the fixing nip is remarkably decreased by the preheating roller 131, so that rippled image defects caused by the entrapment of the vapor of the liquid carrier between heating rollers, as in the prior art, is substantially reduced or eliminated when the image is fixed.

EXAMPLE 2

Figure 5:
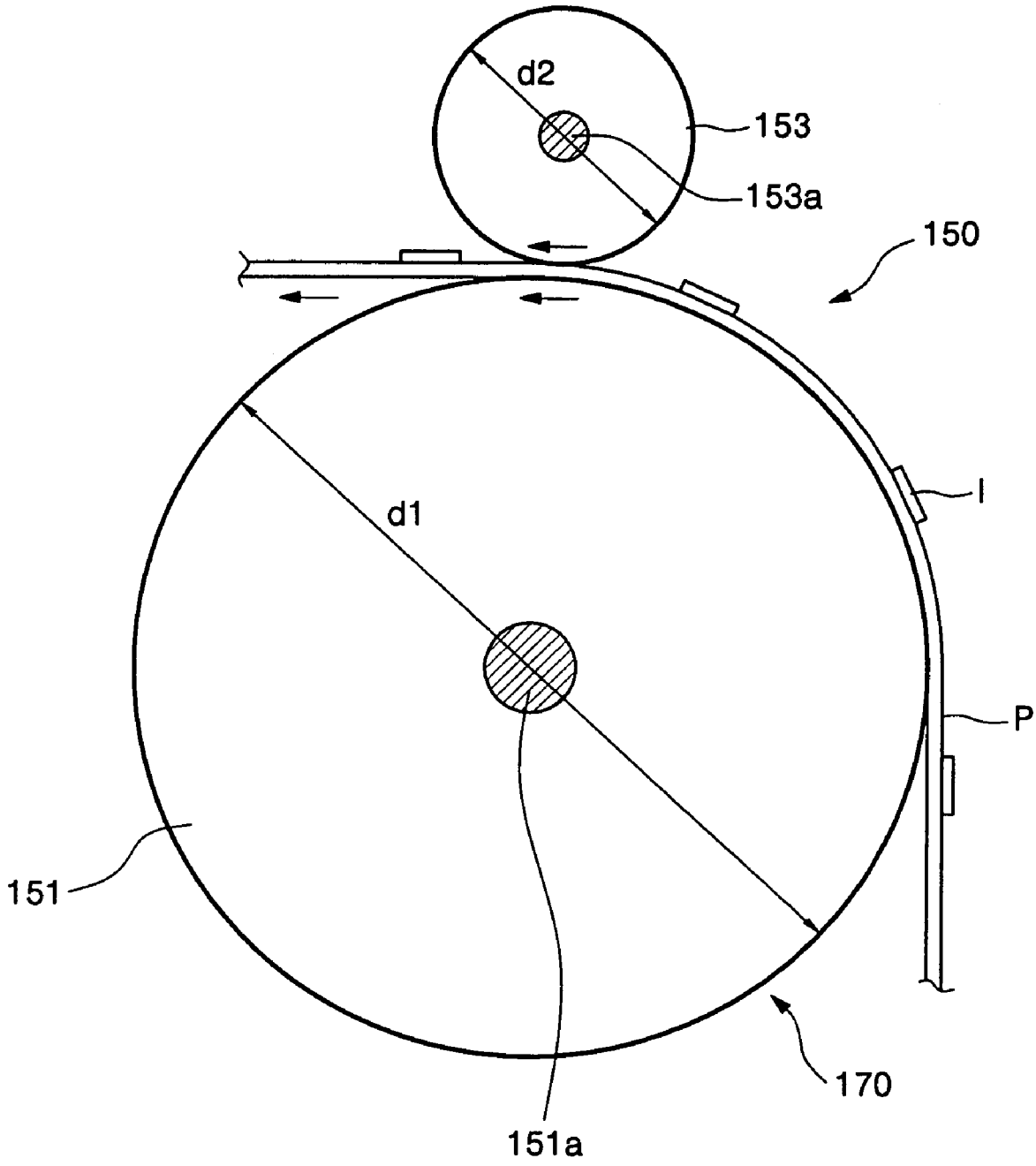
FIG. 5 illustrates an image fixing unit of a wet image forming apparatus according to another embodiment of the present invention.

As shown in FIG. 5, the image fixing unit is comprised of a fixing section 150 having a first fixing roller 151 and a second fixing roller 153, wherein the second fixing roller 153 rotates in close contact with the first fixing roller 151 to feed paper P through a gap (a fixing nip) between the fixing rollers.

Either one of the first and second fixing rollers 151 and 153 is configured as preheating means 170 that is designed to evaporate the liquid carrier contained in the image I by performing a preheating process before the paper P passes through the fixing nip. In FIG. 5, first fixing roller 151 is configured as preheating means 170.

The preheating means 170 is disposed to come into contact with a surface of either one of the first and second fixing rollers 151 and 153. The first fixing roller 151 contacting the paper P has a first heating element 151 a mounted therein. The paper P is configured such that one surface contacts the first fixing roller 151 as a non-image surface (one surface on which the image I is not formed). The image I formed on the paper is adapted to be exposed to the air. Therefore, the heating operation of preheating means 170 causes the liquid carrier contained in the image I to be smoothly evaporated in the air prior to entering the fixing nip between the first and second fixing rollers 151, 153.

In the second aspect of the present invention, the diameters of the first and second fixing rollers 151 and 153 are preferably of diameters d1 and d2 respectively, which are different from each other, though this need not necessarily be the case, as other configurations of the rollers is within the scope of the embodiments of the present invention. Furthermore, the non-image surface of the paper P is preferably brought into contact with the surface of the first fixing roller 151 having the larger diameter.

In an additional aspect of the present invention, a second heating element 153*a* is mounted in the second fixing roller 153 whose surface does not come into contact with the paper P so as to make it possible to enhance a fixing effect. Because of the preheating means, the image I formed on the paper P contains a reduced amount of liquid carrier in a range from at or about 3% to at or about 20% by weight when the image I enters the fixing nip.

The following description will be made about a fixing operation of the image fixing unit constructed as set forth above.

The fixing operation of the image fixing unit constructed as set forth in the second aspect of the present invention will now be described in greater detail. The paper P is first introduced into the fixing nip by the first fixing roller 151 with an image surface of the paper P exposed in the air. In this case, the first heating element 151*a* is mounted in the first fixing roller 151, so that as the paper P is fed in contact with the surface of the first fixing roller 151, the image I formed on the paper P is preheated.

Because the image I formed on the paper P is exposed to the air, vapor, which is generated during evaporation of the liquid carrier contained in the image I according to the preheating operation of the image I, is smoothly released in the air. Just before the preheating process, the liquid carrier contained in the image I is in the range from at or about 70% to at or about 80%. The liquid carrier vapor is then released into the air while being heated by the first fixing roller 151.

After the preheating process is performed, the liquid carrier remaining in the image I is in the range from at or about 3% to at or about 20% just before entering the fixing nip. As a result, the amount liquid carrier which can be turned into vapor at the fixing nip is remarkably decreased by the first fixing roller 151. The result is that rippled image defects caused by evaporation of the liquid carrier when the image is fixed is substantially reduced or eliminated. As can be seen from the foregoing, according to the aspects of the present invention, the paper is brought into contact with the preheating means before the paper enters the fixing nip, and thus the surface of the paper onto which the image is formed is exposed to the air. As a result, evaporation of the liquid carrier can be smoothly performed.

Although an exemplary embodiment of the present invention has been described for illustrative purposes, it is apparent to those skilled in the art that various modifications, additions and substitutions are possible, without departing from the scope and spirit of the invention as disclosed in the accompanying claims.

What is claimed is:

1. An image fixing unit for a wet image forming apparatus, comprising:

a fixing section having a first fixing roller and a second fixing roller, the second fixing roller rotating in close contact with the first fixing roller to feed paper through a fixing nip between the fixing rollers; and a belt disposed on a feed path of the paper and supported by a preheating roller spaced a predetermined distance apart from the first fixing roller to move along an endless path so that the belt is adapted to be fed in contact with a non-image surface of the paper, and the preheating roller being spaced from the second fixing roller;

wherein an image formed on the paper contains a liquid carrier in a range from at or about 3% to at or about 20% by weight when the image enters the fixing nip.

2. The image fixing unit as claimed in claim 1, wherein at least one of the first and second fixing rollers has a heating element mounted therein.

3. An image fixing unit for a wet image forming apparatus, comprising:

a fixing section having a first fixing roller and a second fixing roller which rotates in close contact with the first fixing roller to feed paper through a fixing nip between the fixing rollers, wherein any one of the first and second fixing rollers is disposed to bring a surface thereof into contact with a non-image surface of the paper before the paper passes through the fixing nip, and the fixing roller in contact with the paper has a heating element mounted therein, and an image surface of the paper is not contacted until the image surface reaches the fixing nip;

wherein an image formed on the image surface of the paper contains a liquid carrier in a range from at or about 3% to at or about 20% by weight when the image enters the fixing nip.

4. The image fixing unit as claimed in claim 3, wherein the first and second fixing rollers have different diameters respectively, and the non-image surface of the paper comes into contact with the surface of the fixing roller having a larger diameter.

5. The image fixing unit as claimed in claim 3, wherein the fixing roller whose surface does not come into contact with the paper further comprises a heating element.

6. An image fixing unit for a wet image forming apparatus, comprising:

a fixing section having a first fixing roller and a second fixing roller that rotates in close contact with the first fixing roller to feed paper through a fixing nip between the first and second rollers; and a preheating means disposed on a feed path of the paper before the paper enters the fixing nip and before contact is made with the image surface of the paper, the preheating means being in contact with a non-image surface of the paper to allow the image to be exposed to the air;

wherein an image formed on the image surface of the paper contains a liquid carrier in a range from at or about 3% to at or about 20% by weight when the image enters the fixing nip.

7. A method for fixing an image in a wet image forming apparatus, comprising:

preheating a non-image surface of a paper containing an image that has a content of liquid carrier to evaporate a substantial portion of the liquid carrier in the paper;

moving the preheated paper to a fixing unit such that contact is not made with an image surface of the paper before reaching the fixing unit; and fixing the preheated paper to adhesively secure the image to the paper;

wherein the image formed on the image surface of the paper has a content of the liquid carrier in a range from at or about 3% to at or about 20% by weight when the image enters the fixing nip.

8. The method according to claim 7, wherein the step of preheating comprises:

contacting the non-image surface of the paper with a pre-heating element while an image surface of the paper is exposed to air.

9. The method according to claim 8, wherein the pre-heating element comprises a first fixing roller.

10. The method according to claim 9, wherein the pre-heating element further comprises:

a pre-heating roller and belt configured in an endless loop around the first fixing roller and a pre-heating roller.

11. The method according to claim 10, wherein at least either the first fixing roller or the pre-heating roller contains a heating element.

12. The method according to claim 7, wherein the fixing step comprises: passing paper between the first and second fixing roller.

13. The method according to claim 12, wherein at least one of the first and second fixing rollers comprises a heating element.

14. The method according to claim 7, wherein the step of pre-heating comprises:

heating a pre-heating roller by an internally contained heating element, wherein the preheating roller is in rotational communication with a first fixing roller by a belt, such that the preheating roller heats the non-image surface of the paper containing the content of liquid carrier; and evaporating a substantial portion of the liquid carrier in the paper.

* * * * *